US009526274B2

(12) United States Patent
English

(10) Patent No.: US 9,526,274 B2
(45) **Date of Patent: *Dec. 27, 2016**

(54) ADJUSTABLE COLLAR SHAPING DEVICE FOR SHIRT

(71) Applicant: William Robert English, Plano, TX (US)

(72) Inventor: William Robert English, Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/137,420

(22) Filed: Apr. 25, 2016

(65) Prior Publication Data

US 2016/0235127 A1 Aug. 18, 2016

Related U.S. Application Data

(63) Continuation of application No. 14/198,823, filed on Mar. 6, 2014, now Pat. No. 9,320,302, which is a continuation-in-part of application No. 12/485,871, filed on Jun. 16, 2009, now abandoned.

(51) Int. Cl.
*A41B 3/06* (2006.01)

(52) U.S. Cl.
CPC ..... *A41B 3/06* (2013.01)

(58) Field of Classification Search
CPC ..... A61B 3/06; A61B 1/14
See application file for complete search history.

(56) References Cited

U.S. PATENT DOCUMENTS 579,788 A * 3/1897 Brodeue ..... A41B 3/06 2/132
653,800 A * 7/1900 Gould ..... A41B 3/06 2/132
811,326 A * 1/1906 Reynolds ..... A41B 3/06 2/134
902,576 A * 11/1908 Gustafson ..... A41D 27/18 2/132
1,388,661 A * 8/1921 Murphy ..... A41B 3/08 2/131
1,658,219 A * 2/1928 Anderson ..... A41B 3/08 2/132
1,751,655 A * 3/1930 Oppermann ..... A41B 3/06 2/132

(Continued)

FOREIGN PATENT DOCUMENTS

WO 2012162414 11/2012

*Primary Examiner* — Richale Quinn
(74) *Attorney, Agent, or Firm* — Fish & Richardson P.C.

(57) ABSTRACT

A moldable collar stay device for a shirt turnover collar comprising a collar stay body and dual collar stay inserts. The shape and the length of the present device may be adjusted by fasteners which facilitate changes to the angle of the collar stay inserts and the length of the collar stay body. The device also may be shaped to accentuate the shape of a user's face. Each collar stay insert may be placed inside collar stay pockets at opposite corners of the shirt collar while the stay body lies along the exterior bounds shirt collar. The shirt wearer may adjust the device around the periphery of the collar to the desired position. Once positioned, the device will remain concealed with the collar and collar stay pockets while maintaining the ability to alter the collar shape, the collar stay length and the angle of the collar stay inserts.

2 Claims, 7 Drawing Sheets

(56) References Cited

U.S. PATENT DOCUMENTS 1,820,287 A * 8/1931 Morck ..... A41B 3/06 2/116
1,875,886 A * 9/1932 Ramont ..... A41B 3/12 2/132
1,908,525 A * 5/1933 Manaster ..... A41B 3/06 2/132
1,923,577 A * 8/1933 Manaster ..... A41B 3/06 2/132
2,004,288 A * 6/1935 Krick ..... A41B 3/06 2/132
2,014,952 A * 9/1935 Robbins ..... A41B 3/06 2/132
2,066,636 A * 1/1937 Manaster ..... A41B 3/06 2/132
2,123,274 A * 7/1938 Dailey ..... A41B 3/12 2/132
2,304,464 A * 12/1942 Manaster ..... A41B 3/06 2/132
D137,846 S * 5/1944 Manaster ..... D2/624
2,371,338 A * 3/1945 Manaster ..... A41B 3/12 2/132
RE22,698 E * 11/1945 Manaster ..... A41B 3/12 2/132
2,423,776 A * 7/1947 Humpola ..... A41D 25/027 2/132
2,425,872 A * 8/1947 Forsland ..... A41B 3/12 2/132
2,438,325 A * 3/1948 Pophal ..... A41D 25/12 2/132
2,439,088 A * 4/1948 Herr ..... A41B 3/06 2/132
2,487,583 A * 11/1949 Patch ..... A41B 3/06 2/132
2,639,436 A * 5/1953 Gavrilovich ..... A41B 3/06 2/132
2,655,659 A * 10/1953 Swearingen ..... A41D 13/046 2/52
4,286,337 A * 9/1981 Malouf, Jr. ..... A41B 3/06 2/116
6,202,221 B1 * 3/2001 Ackley, Jr. ..... A41C 1/14 2/255
6,526,597 B1 * 3/2003 Shepard ..... A41F 9/00 2/236
7,086,092 B1 * 8/2006 Cruz ..... A41F 1/002 2/132
8,296,865 B2 * 10/2012 Garcia ..... A41B 3/06 2/117
2002/0113099 A1 * 8/2002 Kim ..... B65D 85/182 223/81
2005/0066425 A1 * 3/2005 Kozlarek ..... A41B 1/14 2/256
2010/0313331 A1 * 12/2010 English ..... A41B 3/06 2/132
2011/0113526 A1 * 5/2011 Harris ..... A41B 3/06 2/132
2011/0289650 A1 * 12/2011 Arrona ..... A41B 3/06 2/129
2012/0023640 A1 * 2/2012 Gutierrez Garcia ..... A41B 3/06 2/116
2014/0223640 A1 * 8/2014 English ..... A41B 3/06 2/256
2014/0345031 A1 * 11/2014 Reidsema et al. ..... A41B 3/06 2/132
2015/0020290 A1 * 1/2015 Yarbrough ..... A41B 3/00 2/129

* cited by examiner

ADJUSTABLE COLLAR SHAPING DEVICE FOR SHIRT

CROSS-REFERENCE TO RELATED APPLICATIONS

This patent is a continuation of U.S. patent application Ser. No. 14/198,823, filed Mar. 6, 2014, which is a continuation-in-part of U.S. patent application Ser. No. 12/485,871, filed on Jun. 16, 2009, the entire contents of which are hereby expressly incorporated by reference herein in their entireties.

TECHNICAL FIELD

The present invention relates to an adjustable device for shaping and molding a shirt turnover collar to complement the user's face while it remains discreetly concealed beneath the turned down turnover collar.

DESCRIPTION OF PRIOR ART

The use of collar stays with shirts has been known and commercially available for a long period of time. For example, collar stays may be inserted, into channels or pockets at the shirt collar corners or may be permanently imbedded in the collar at the time of manufacture. Prior it constructions may utilize rigid, non-bendable collar stays with tapered lower ends to create and maintain straight, flat collar corners. Collar stays may be positioned inside or outside of the shirt collars. The primary goal of these stay designs is to provide rigid support, rather than to customize the shape and direction of the collar stays or collars. For instance, traditional stays may keep the collar corners down but cannot modify or customize the remainder of the shirt collar. Many traditional collar stays end up out of shape from extended use and will eventually lose their rigidity. Outside type collar stays are generally limited in collar support and do not provide customizable support along the span of the entire shirt collar neckline. Metal stays with springs for tension are known to give shirt collars an unnatural bulky appearance and are not capable of maintaining their shape or customization. Further, they are subject to being due to their miniscule size.

Collar stays of prior art have included individual stays for each corner pocket as well as devices that are simultaneously positioned in each pocket with a connecting portion between the dual corner end pieces. The individual collar stays do not shape or manipulate any portion of the shirt collar around the periphery or exterior boundary of the collar or user's neck. More recent collar stay devices may provide a single device that may be positioned in both collar stay pockets. Many of these devices function by resting at the front of the shirt or near the shirt button. In any case, these devices will be visible to the user and passersby as they are not concealed within the shirt or collar. In addition, these devices are not of sufficient length or durability to shape or manipulate the entirety of the shirt collar.

It is well known that the right collar on the right type of face is an important aspect of wearing a shirt. The collar should be customizable to emphasize, or deemphasize, various facial features of a person. A partial function of a shirt collar is to properly frame the face and accentuate a person's facial strengths and minimize the weaknesses. The present invention, utilizing the existing collar stay pockets of a standard turnover collar, extends through the periphery of the entire shirt collar thereby allowing the entire shirt collar to be customized into new and unique positions. The present invention allows a user to maximize and improve the function of his or her shirt collar by adjusting collar shape to accentuate his or her face. The user can readily adjust the entire stay device into the desired shape. Not only is the shape of the present device adjustable, the length of the present device may be adjusted to accommodate users with different neck sizes and different shirt collars. The present invention, white bendable and customizable, is of sufficient size as to not be readily misplaced as with diminutive standard collar stays.

OBJECTS OF THE INVENTION

A primary object of the present invention to provide an adjustable collar stay device, with respect to shape and length, which may accommodate different face types as well as different neck sizes.

It is another object of the present invention to provide a moldable collar stay device, comprised of a stay body connecting dual collar stay inserts for each collar stay pocket at the end of a standard turnover collar shirt, which may be adjusted to alter the shape and appearance of a shirt collar.

It is another object of the present invention to provide a moldable collar device which may be inserted in both collar stay pockets as well as extend around the entire periphery of a standard turnover shirt collar in order to modify the shape of the entire shirt turnover collar.

It is an additional object of the present invention to provide a collar stay device that is relatively rigid to maintain its shape but moldable to alter the shape of entire shirt collar.

It is another object of the present invention to provide a collar stay device in which shape and length of the collar stay body as well as the angle of the collar stay inserts may be altered to accommodate various users.

With the above and other objects in view, the present invention resides in the novel features of form, construction, arrangement and combination of parts presently described and pointed out in the claims.

SUMMARY OF THE INVENTION

The present invention is an adjustable and moldable collar stay device for a shirt turnover collar which spans the periphery of the turnover collar with each end of said moldable collar stay device being inserted into the collar stay pockets at the ends of a standard turnover collar of a shirt. The collar stay device consists of dual collar stay inserts joined by a collar stay body, wherein the entire collar stay device is of such a length as to span the periphery or exterior bounds of a turnover collar. The moldable collar stay device is for use with a shirt with a collar that may be folded up or folded down, commonly referred to as a "turnover collar." Additionally, such a shirt typically includes prefabricated collar stay pockets positioned at opposite ends of the turnover collar.

The shirt wearer may adjust the turnover collar to the desired position or shape by contorting the collar stay device attached to the turnover collar. The present invention is a moldable and customizable collar stay device made of a bendable material capable of retaining its new shape and returning to its original configuration. In fact, due to the adjustable and flexible nature of the present collar stay device, it may be shared by friends, roommates, siblings, fathers and sons, without regard to individual neck measurements, since the length of the device may also be adjusted. The length of the present device may be increased by extending the midsection of the device while length may be shortened by contracting the midsection of the device.

The present collar stay device includes two collar stay inserts, which are tapered end points identically formed and connected by a collar stay body, a moldable length of material between each tapered end point. The tapered ends of the collar stay inserts ensure that the ends do not injure users or poke through collar stay pockets. Each collar stay insert may be placed into and rest within the prefabricated collar stay pockets of the turnover collar of a shirt. In use, the user may either 1) lay the collar stay device against a turned up collar, insert each collar stay insert into the corresponding collar stay pocket, and turn down the turnover collar or 2) insert one collar stay insert into a collar stay pocket, place the collar stay body around the neck of the shirt and beneath the turnover collar, insert the second collar stay insert into a second collar stay pocket, before adjusting the turnover collar with enclosed collar stay device.

In addition, the collar stay device may be adjusted before or after being joined to the turnover collar. For instance, the user may decide to lengthen or shorten the collar stay device to accommodate that user's neck measurements and face shape, which may vary from the immediate past user. Alternatively, during or after placement of the collar stay device against and into the turnover collar, the user may determine a need to adjust the length of the collar stay body or to alter the angles of the collar stay inserts. Adjustment may be done before, during or after attachment of the collar stay device to the turnover collar of a standard shirt.

In the present collar stay device, each collar stay insert is connected to an opposite end of the length of material or collar stay body. The attached collar stay insert may be rotated to a around the end of the collar stay body in order to alter the angle between the collar stay insert and the collar stay body. This rotation creates alternate shapes to accommodate various types of collars. The collar stay inserts may be attached to the collar stay body with fasteners such as grommets, rivets, snaps, button, clasp, buckle, latch or other fastening means. However, in this embodiment, grommets are the preferred method of fastening collar stay inserts to the collar stay body. The collar stay inserts are fastened to the collar stay body in such a manner as to allow full rotation of the collar stay inserts around the collar stay body.

In addition, the collar stay body also includes a number of grommets or fasteners to accommodate the supplemental length of material which allows for adjustment to the length of the collar stay device. Additional fasteners are present along the collar stay body to provide sufficient give for adjusting the length. These lengthening fasteners will be closer together when the collar stay device is shortened and further apart as the collar stay device is lengthened. At a minimum, a collar stay device will have at least four (4) fasteners: two fasteners (2) to connect the dual collar stay inserts to the collar stay body and two (2) fasteners along the collar stay body to allow for adjustments in length. In the present embodiment, there are at least six (6) fasteners: two (2) fasteners to connect the dual collar stay inserts to the collar stay body, two (2) fasteners at the left side of the collar stay body to lengthen and shorten the left side of the collar stay device and two (2) at a right side, opposite the left side, of the collar stay body to lengthen and shorten the right side of the collar stay device. However, it is to be understood that different numbers of fasteners or grommets may be used depending on the amount of collar stay lengthening desired by the user or manufacture of the present device. Despite the presence of a number of grommets or fasteners, the present device maintains its stability, sturdiness and moldable traits.

In another embodiment, the moldable collar stay device may be made of an alloy with shape memory or molded plastic. A shape memory alloy is an alloy that "remembers" its shape, and can be returned to that shape after being deformed, by applying heat to the alloy. In the present invention, a shape memory alloy or moldable plastic may be used to mold the collar stay device. Shape memory alloys include nickel-titanium, copper-aluminum-nickel, copper-zinc-aluminum, and iron-manganese-silicon. This embodiment may also use shape-memory plastic that can be formed at room temperature. While the moldable collar stay device may be either a removable device for use with a shirt or manufactured within the shirt collar before delivery to consumers, the present collar stay device is removable in this embodiment.

As stated above, it is well known that the proper collar on the certain type of face is an important aspect of wearing a shirt. The function of a shirt collar, in part, is to properly frame the face and accentuate that person's facial strengths. The collar in conjunction with the present moldable collar stay device, may be customizable to emphasize, or deemphasize, various facial features of an individual. The function of a shirt collar, in part, is to properly frame the face and accentuate that person's facial strengths. The present invention allows a user to maximize and improve the function of his or her shirt collar by adjusting the length and configuration or shape of the present collar stay device. The present invention may also provide the fashion industry with an easily accessible and usable tool by which to mold and shape shirt collars while achieving a consistent look between performances. In addition, different users or fashion models with various body measurements may utilize the same collar stay device since the present device may be readily adjusted to accommodate body differences.

Figure 2:
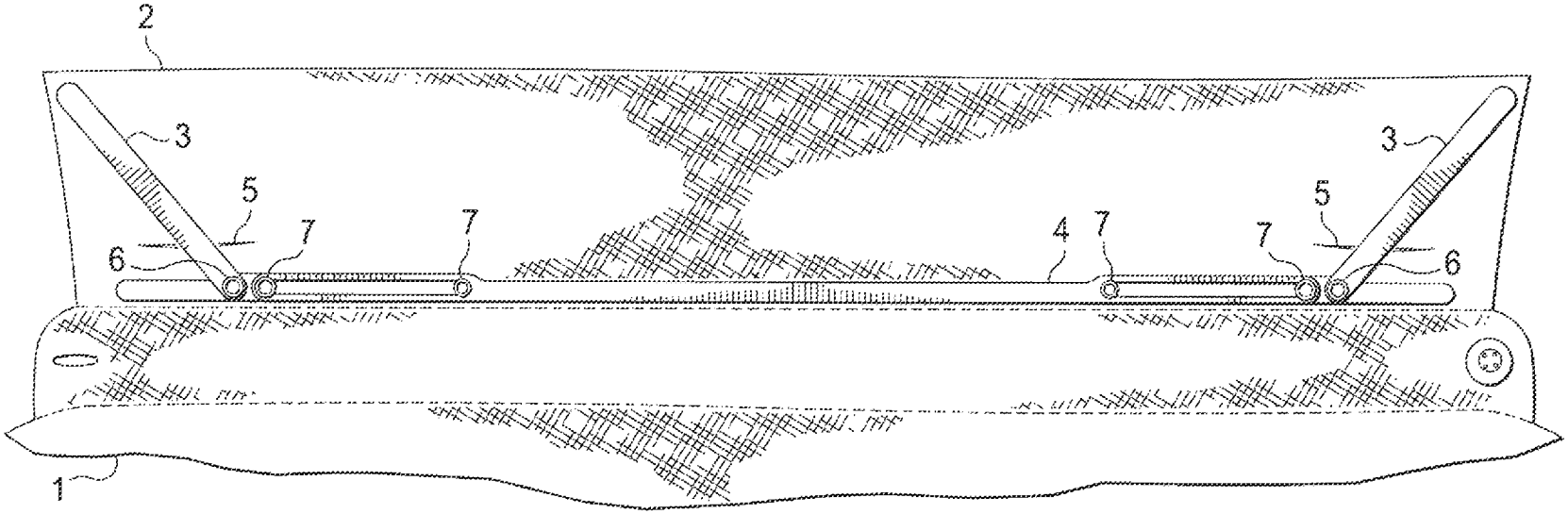
Figure 3:
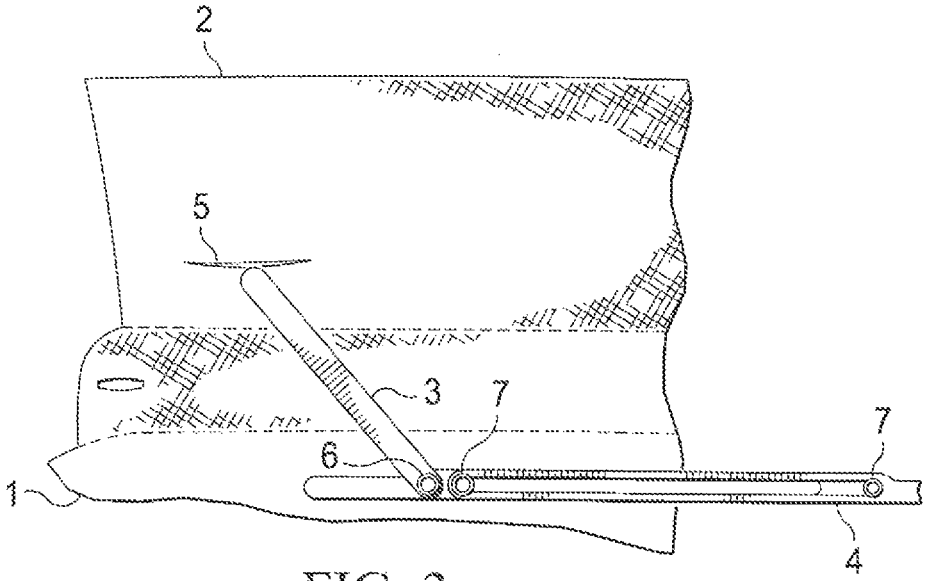
Figure 4:
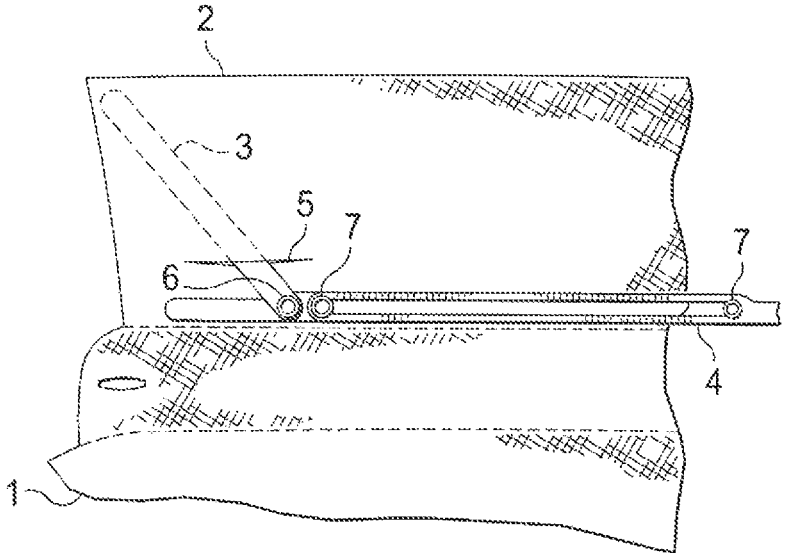
Figure 5:
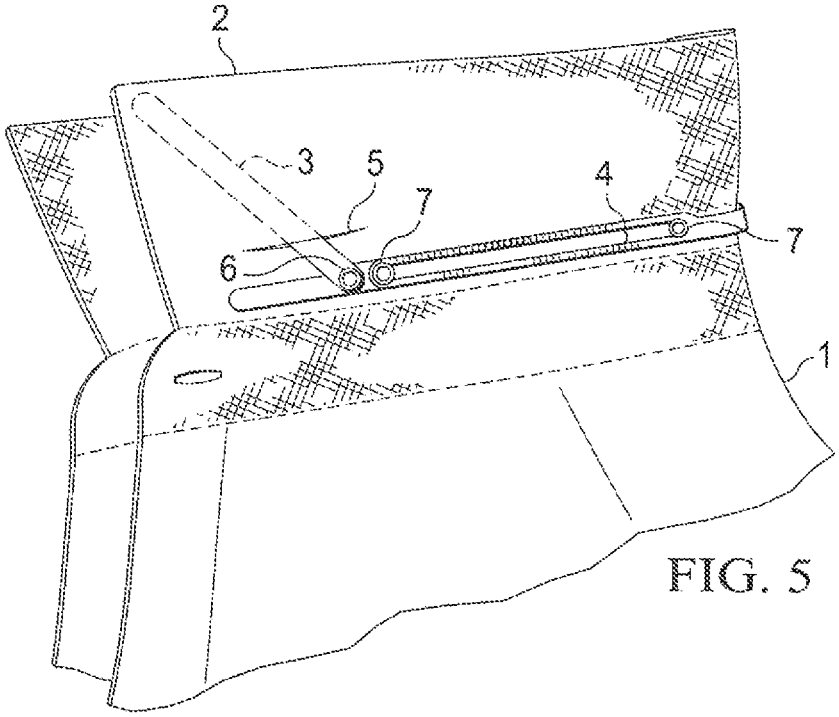
Figure 6:
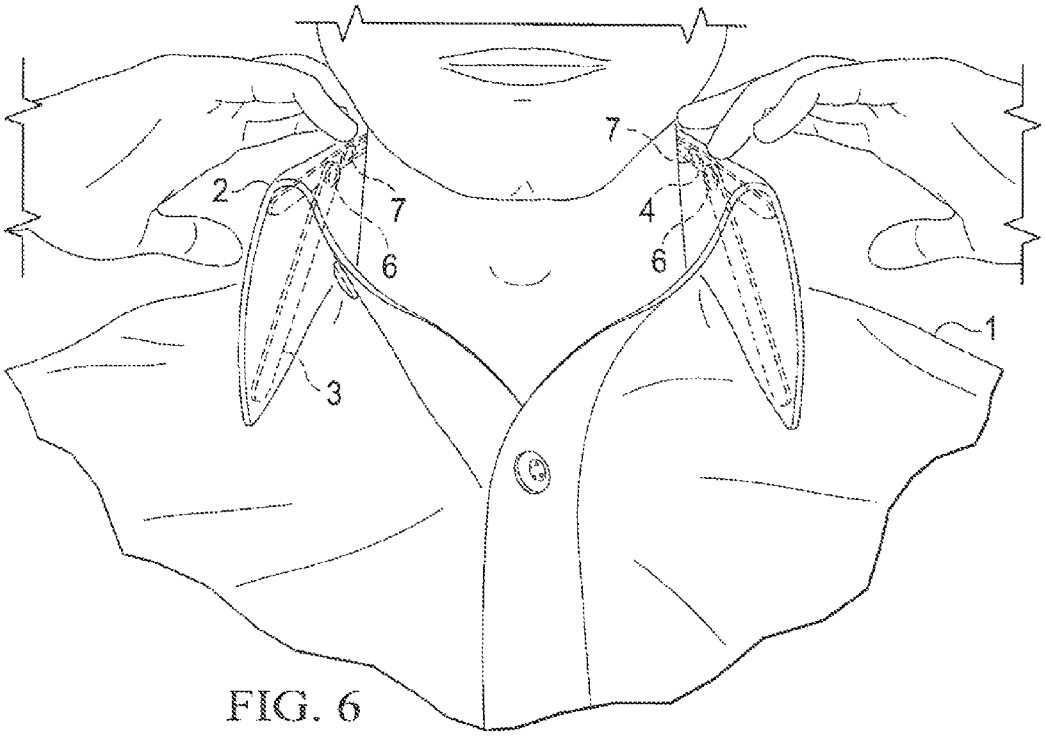

Ref. 1 is a shirt;

Ref. 2 is a turnover collar attached to said shirt;

FIG. 2 is a rear view of the collar stay against an open collar;

Ref. 1 is a shirt;

Ref. 2 is a collar attached to said shirt;

Ref. 3 is a collar stay insert of the collar stay device;

Ref. 4 is the stay body of the collar stay device;

Ref. 5 is a collar stay pocket on the collar of the shirt;

Ref. 6 is a fastener for the collar stay insert;

Ref. 7 is a fastener for the collar stay body;

FIG. 3 is partial side view of the collar stay near the collar stay pocket;

Ref. 1 is a shirt;

Ref. 2 is a collar attached to said shirt;

Ref. 3 is a collar stay insert of the collar stay device;

Ref. 4 is the stay body of the collar stay device;

Ref. 5 is a collar stay pocket on the collar of the shirt;

Ref. 6 is a fastener for the collar stay insert;

Ref. 7 is a fastener for the collar stay body;

FIG. 4 is a partial side view of the collar stay entering a collar stay pocket;

Ref. 1 is a shirt;

Ref. 2 is a collar attached to said shirt;

Ref. 3 is collar stay insert of the collar stay device;

Ref. 4 is the stay body of the collar stay device;

Ref. 5 is a collar stay pocket on the collar of the shirt;

Ref. 6 is a fastener for the collar stay insert;

Ref. 7 is a fastener for the collar stay body;

FIG. 5 is a side view of the collar stay entering a collar stay pocket;

Ref. 1 is a shirt;

Ref. 2 is a collar attached to said shirt;

Ref. 3 is collar stay insert of the collar stay device;

Ref. 4 is the stay body of the collar stay device;

Ref. 5 is a collar stay pocket on the collar of the shirt;

Ref. 6 is a fastener for the collar stay insert;

Ref. 7 is a fastener for the collar stay body;

FIG. 6 is front view of the collar stay with the collar;

Ref. 1 is a shirt;

Ref. 2 is a collar attached to said shirt;

Ref. 3 is collar stay insert of the collar stay device;

Ref. 4 is the stay body of the collar stay device.

Figure 7:
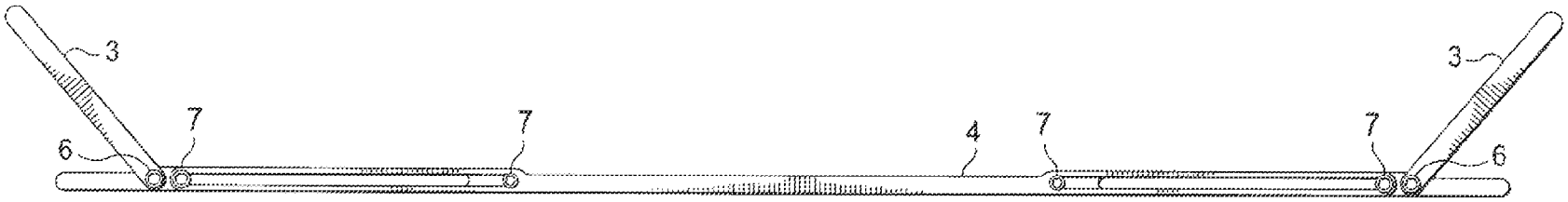

Ref. 6 is a fastener for the collar stay insert;

Ref. 7 is a fastener for the collar stay body;

FIG. 7 is a perspective view of the extended collar stay device;

Ref. 3 is collar stay insert of the collar stay device;

Ref. 4 is the stay body of the collar stay device.

Ref. 6 is a fastener for the collar stay insert;

Ref. 7 is a fastener for the collar stay body;

DETAILED DESCRIPTION OF DRAWINGS

While the above description is of the preferred embodiment of the present invention, it should be appreciated that the invention may be modified, altered or varied without deviating from the scope and fair meaning of the following claims.

Referring generally to FIGS. 1-7, the present system is a molded collar stay device which includes a collar stay body portion and dual collar stay inserts at opposite end of the collar stay body. In use, the first collar stay insert of the collar stay device would be inserted into a first prefabricated collar stay pocket of a turnover collar shin, the second collar stay insert of the collar stay device is inserted into a second prefabricated collar stay pocket of a turnover collar shirt while the collar stay body is lies around the user's neck, positioned between the top of the shirt and beneath the turnover collar. A user may adjust the length of the device before or after the device has been placed inside a turnover collar of a shirt. Length may be adjusted by increasing or decreasing the distance between the first pair and second pair of fasteners at a left side and right side of the collar stay body. Once the device is in place, the user would have the option of reshaping the collar stay device by molding the present device through the collar. In addition, the collar stay will remain concealed underneath the turned down turnover collar in a position between the turnover collar and the top of the shirt. Without regard to the presence or absence or a neckpiece, tie, or buttons, the present collar stay device will remain concealed since it lies around the rear edge of the user's neck. In addition, users of varying neck sizes may use the same collar stay device since the length may be readily adjusted to accommodate different users.

Figure 1:
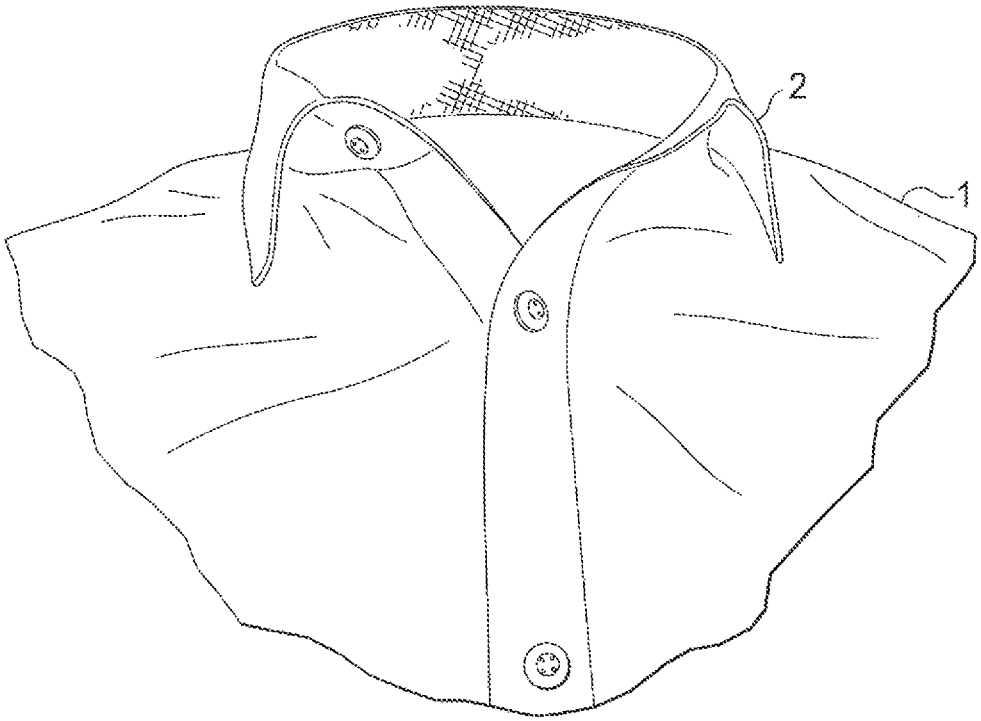
FIG. 1 is view of a shirt with a collar.

With reference to FIG. 1, this view is a front view of a shirt 1 with a standard turnover collar 2. The present collar stay device may be used on a standard shirt 1 with dual sleeves, a back portion, a front portion and a turnover collar 2. The collar 2 is positioned both above the top of the shirt and along the upper edge of the back portion of the shirt. The collar 2 is usually manufactured with prefabricated collar stay pockets at each corner. The length of the turnover collar 2 is the distance between a first prefabricated collar stay pocket at a first end of the turnover collar and a second prefabricated collar stay pocket at a second end of the turnover collar.

With reference to FIG. 2, this view is a rear view of the collar stay device against an open collar 2 of a shirt 1. When the collar 2 is in an open position, the collar is turned up so that the interior of the turnover collar and the top portion of the shirt back are exposed. The turnover collar 2 has prefabricated collar stay pockets 5 at the first corner of the collar and second corner of the collar. As in many traditional shirts, the turnover collar also includes collar stay pockets 5 at each end of the collar. The collar stay device contains a stay body 4, a first end and a second end. The stay body is positioned between the first collar stay insert 3 and the second collar stay insert 3. The first collar stay insert 3 is attached to the first end of the collar stay device with a collar stay fastener. The second collar stay insert 3 is attached to the second end of the collar stay device with a collar stay fastener. In addition, adjustment mechanisms located along the stay body 4 allow the user to alter the length of the stay device to accommodate various users and shirt collars. In this embodiment, four (4) fasteners or grommets are shows. In this embodiment, two (2) pairs of fasteners [6, 7] are between the first end (left) of the collar stay device and the second end (right) of the collar stay device. Each pair of fasteners may be contracted to shorten the length of the collar stay body or extended to increase the length of the collar stay body 4. In this embodiment, a fastener for a collar stay insert 6 connects the insert to the collar stay body while a fastener for the collar stay body 7 facilitates changes in the length of the collar stay body 4.

With reference to FIG. 3, this view is a partial side view of the collar stay near the entrance point of a collar stay pocket. The traditional turnover collar 2 usually includes collar stay pockets 5 at each end of the collar, in addition, the turnover collar 2 is attached to the top portion of the back of the shirt 1. In a turned up position, the collar stay would be visible above the shirt back and adjacent to the interior surface of the turnover collar. The present collar stay device includes a collar stay body 4 and dual collar stay inserts 3. To adjust the shape of the collar stay device, the user may alter the angle of the collar stay insert 3 by rotating the collar stay insert 3 secured to the collar stay body by the fastener for the collar stay insert 6. In position, a first collar stay insert 3 would be placed inside a first collar stay pocket 5. The present system also includes adjustment mechanisms to alter the length of the collar stay device. To adjust the length of the first end of the collar stay body, the length of the collar stay body 4 may be extended by gently pulling the fasteners apart to extend the distance between the collar stay body fasteners 7.

With reference to FIG. 4, this view is a partial side view of the collar stay partially inside a collar stay pocket. The collar stay pocket 5 is located at the corner of the collar 2 attached to the shirt 1. To adjust the shape of the collar stay device, the use may alter the angle of the collar stay insert 3 by rotating the collar stay insert secured to the collar stay body 4 by the fastener for the collar stay insert 6. After the desired angle is achieved, the collar stay insert 3 may be placed inside the collar stay pocket 5. To adjust the length of the first end of the collar stay body 4, the length of the collar stay body may be extended by gently pulling the fasteners apart to extend the distance between the collar stay body fasteners 7.

With reference to FIG. 5, this view is a collar stay pocket on the collar of the shirt. The collar stay pocket 5 is located at the corner of the collar attached to the shirt 2. To adjust the shape of the collar stay device, the user may alter the angle of the collar stay insert 3 by rotating the collar stay insert 3 secured to the collar stay body by the fastener for the collar stay insert 6. After the desired angle is achieved, the collar stay insert 3 may be placed inside the collar stay pocket 5. To adjust the length of the first end of the collar stay body 4, the length of the collar stay body may be extended by gently pulling the fasteners apart to extend the distance between the collar stay body fasteners 7. The shape of the collar stay device may also be altered by molding the device into a shape that accentuates the contours of the user's face. The collar stay body 4 extends from the first collar stay pocket 5, around the back portion of the neck, covered by the collar, and ends at the second collar stay pocket 5. The entire collar stay device lies around the periphery of the collar around the user's neck when the shirt is in use.

With reference to FIG. 6, this view is a front view of the collar stay with the collar. When the turnover collar is in a closed or turned down position, the interior surface of the turnover collar 2 is adjacent to the back portion of the shirt 1. The turnover collar of the shirt is positioned around the user's neck, from a first side, around the rear of the neck, to a second side. The present collar stay device spans the length of the turnover collar 2. To adjust the shape of the collar stay device, the user may alter the angle of the collar stay insert 3 by rotating the collar stay insert secured to the collar stay body 4 by the fastener for the collar stay insert 6. After the desired angle is achieved, the collar stay insert 3 may be placed inside the collar stay pocket 5. To adjust the length of the first end of the collar stay body 4, the length of the collar stay body may be extended by gently pulling the fasteners apart to extend the distance between the collar stay body fasteners 6. In order to adjust the shape of the collar stay device, the user can mold the device, through the shirt, with the user's hand since the collar stay is moldable and will hold its altered shape. In any case, the device will remain concealed beneath the turnover collar 2 whether or not the user decides to wear a tie, other neckpiece or leave the shirt buttoned, partially buttoned or completely open. In addition, the device may be used by various users with differing neck sizes since the device may be readily adjusted to accommodate different dimensions.

With reference to FIG. 7, this view is a front view of the fall collar stay device. The present collar stay device consists of a collar stay body 4 and dual collar stay inserts 3 at opposite ends of the collar stay body. Each collar stay insert 3 is attached to the collar stay body 4 with a fastener 6. Additional fasteners 7 are located along the collar stay body to accommodate adjustments in the length of the collar stay body. To adjust the shape of the collar stay device, the user may alter the angle of the collar stay insert 3 by rotating the collar stay insert secured to the collar stay body 4 by the fastener for the collar stay insert 6. To adjust the length of the first end of the collar stay body 4, the length of the collar stay body may be extended by gently pulling the fasteners apart to extend the distance between the collar stay body fasteners 7.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure and the following claims.

What is claimed is:

1. A collar stay device, comprising:

a stay body having a solid middle having a first width, a first end portion having a second width and defining a slot, and a second end portion having the second width, wherein the solid middle connects the first end portion to the second end portion, and the first width is smaller than the second width;

a component includes a solid end portion having a third width smaller than the second width;

a first fastener connected to the stay body and adapted to retain the component adjacent the stay body;

a second fastener connected to the first component and adapted to retain the stay body adjacent the first component, wherein the first fastener and the second fastener enable the stay body to slide substantially parallel relative to the component;

a first collar stay insert pivotally attached to the solid end portion of the first component and having a length longer than the solid end portion of the first component; and a second collar stay insert pivotally attached to the second end portion and having a length longer than the solid first end portion of the second component.

2. The collar stay device of claim 1, wherein the stay body comprises shape memory alloy, and the first collar stay insert and the second collar stay insert comprise plastic.

* * * * *